US005176470A

United States Patent [19]

Lütgendorf

[11] Patent Number: 5,176,470

[45] Date of Patent: Jan. 5, 1993

[54] WATER-TIGHT BORE SHAFT FOUNDATION

[75] Inventor: Hans-Otto Lütgendorf, Marl, Fed. Rep. of Germany

[73] Assignee: Gewerkschaft Auguste Victoria, Marl, Fed. Rep. of Germany

[21] Appl. No.: 689,288

[22] PCT Filed: Oct. 12, 1990

[86] PCT No.: PCT/DE90/00783

§ 371 Date: Jun. 13, 1991

§ 102(e) Date: Jun. 13, 1991

[87] PCT Pub. No.: WO91/11589

PCT Pub. Date: Aug. 8, 1991

[30] Foreign Application Priority Data

Jan. 27, 1990 [DE] Fed. Rep. of Germany ..... 4002457

[51] Int. Cl.[5] ..... E21D 5/01

[52] U.S. Cl. ..... 405/133; 405/135; 405/249; 405/252

[58] Field of Search ..... 405/133, 135, 147, 236, 405/249, 250, 251, 252

[56] References Cited

U.S. PATENT DOCUMENTS 4,401,397 8/1983 Sommer et al. ..... 405/133

4,465,405 8/1984 Dürfeld ..... 405/150.1

4,473,322 9/1984 Echols et al. ..... 405/133

FOREIGN PATENT DOCUMENTS 3629555 3/1988 Fed. Rep. of Germany .

2237591 5/1991 United Kingdom ..... 405/229

OTHER PUBLICATIONS

Glückauf, "Das Abteufen und Ausbaurn der Gefrierschächte Wulfen lund Z" pp. 1473–1495, Dec. 1964.

*Primary Examiner*—Randolph A. Reese
*Assistant Examiner*—Arlen L. Olsen
*Attorney, Agent, or Firm*—Anderson, Kill, Olick & Oshinsky

[57] ABSTRACT

The lower end of an outwardly tight shaft structure (3) for a bore shaft (1) rests on a tilting joint arrangement (15, 20). This arrangement includes a hydraulic thrust bearing (15) at the end face of the shaft structure (3) and a hydraulic annular cylinder (20) at the circumference of the lower end of the shaft structure (3). Thus, this tilting joint arrangement (15, 20) is located between the shaft structure (3) and the base (10) and permits tilting of the shaft structure (3) relative to the ground (12) without impairing the water-tightness of the bore shaft foundation.

5 Claims, 2 Drawing Sheets

WATER-TIGHT BORE SHAFT FOUNDATION

BACKGROUND OF THE INVENTION

The invention relates to a water-tight bore shaft foundation.

In shafts which are manufactured in accordance with the freezing procedure, various solutions for mining-insensitive foundations are known. However, these solutions cannot be used in bore shafts because in bore shafts the foundation area is not accessible.

Foundations which have been known in the past for bore shafts are connected to the ground and, therefore, are mining-sensitive. In these foundations, after the shaft bore has been finished, the outer tight shaft structure is lowered as a pontoon by means of ballast water and its own weight until the intended end position is reached. In this end position, the lower end of the shaft structure is surrounded with a base which is made of underwater concrete introduced between the ground and the shaft structure. After the underwater concrete has hardened, the annular space between the shaft structure and the ground above the base is filled with soft asphalt which displaces the drilling liquid in the annular space. The disadvantage of such a bore shaft foundation is the fact that the lower end of the shaft structure is mounted rigidly, so that mining movements of the ground—possibly in conjunction with inclinations of the shaft structure relative to the shaft axis—may irreparably damage the bore shaft foundation and, thus, the bore shaft foundation may leak.

The invention is based on the problem of constructing a water-tight bore shaft foundation according to the features in the preamble of claim 1 in such a way that mining movements of the ground no longer can have a negative influence on the water-tight quality of the bore shaft foundation, even if substantial curvatures of the shaft axis occur.

Thus, the shaft structure is now placed with its lower end on a liquid and is on the outside surrounded completely by liquid. The hydraulic thrust bearing absorbs the vertical loads, while the circumferential hydraulic annular cylinder carries out the yielding and tightening functions. These two elements form an articulated arrangement which makes it possible for the shaft structure to tilt by up to 2% of inclination change relative to the base, without impairing the water tightness of the bore shaft foundation. In addition, the bore shaft foundation is free of rearrangements of forces.

The hydraulic thrust bearing serves for the permanent transmission of the own weight of the shaft structure through the base into the ground. The hydraulic medium in the thrust bearing is subjected to a pressure which corresponds to the own weight of the shaft structure, independently of the state of tilting of the shaft structure which may occur due to mining influences. Consequently, vertical pressures distributed over the circumference are uniformly transmitted into the ground in any tilting state. In this manner, the load acting on the ground as well as on the shaft structure is kept as low as possible. The hydraulic annular cylinder which surrounds the lower vertical portion of the shaft structure seals the bore shaft in a yielding manner relative to the base. It is of significance in this connection that the annular cylinder extends to a sufficient extent upwardly along the shaft structure from the thrust bearing into the annular space with the soft asphalt. As a result, this asphalt can transmit its hydraulic pressure continuously on the hydraulic medium in the annular cylinder.

The features of the invention make it possible to support a shaft structure for a bore shaft completely slidingly in the water-tight portion. This provides the advantage that any damage in the non-water-tight, ground-connected shaft structure underneath the tilting joint arrangement can be repaired relatively easily from the hollow space of the bore shaft. Therefore, such a mining-insensitive shaft structure for bore shafts which is mounted slidingly in a water-tight manner, makes it possible to arrange bore shafts even in mining areas with significant mining influences in order to supply these mining operations with fresh air.

The thrust bearing cushion preferably has an oval cross-section with a flat upper side which is in contact with the lower end face of the shaft structure and has a flat underside which is in contact with the base. The width of this oval cushion is adapted to the wall thickness of the shaft structure. Its height is between 100 and 200 mm. The walls of the cushion can be provided with a statically sufficient thickness. The cushion is filled with a non-corrosive medium, so that corrosion of the steel skin of the cushion can be excluded.

As already mentioned above, vertical pressures from the own weight of the shaft structure are uniformly conducted into the ground through the thrust bearing and the base. Horizontal transverse forces resulting from the curvature of the shaft axis are transmitted through friction and adherence from the shaft structure to the flat upper side of the cushion. The transverse forces are conducted through shear stresses from the other side through the radially inner and outer curved connecting portions to the flat underside of the cushion and are conducted from there into the ground. The cushion is constructed in such a way that it is continuously capable of absorbing annular tension stresses from the pressure of the hydraulic medium. When the cushion is welded together from various sheet metals, the welding seams must be adapted to these annular tension stresses.

The thrust bearing may be connected with the lower end face of the shaft structure.

As far as the circumferential annular cylinder of the hydraulic tilting joint arrangement is concerned. As is the case in the thrust bearing, this annular cylinder also is a hollow steel body which is closed to all sides and is filled with liquid. The annular cylinder which has the shape of a circle in horizontal cross-section has a radial thickness of about 100 mm to 200 mm and has to be constructed with a height of only a few meters and may be provided with a relatively thin outer steel jacket which is tightly connected to the outer wall of the shaft structure. The annular cylinder extends beyond the annular portion of the base which surrounds the shaft structure into the soft asphalt thereabove to such an extent, but at least by 1 m, that the hydraulic pressure of the asphalt in the annular space between the ground and the shaft structure is transmitted through the relatively thin steel jacket of the annular cylinder to the hydraulic medium in the annular cylinder. Consequently, tilting of the shaft structure results also in a tilting of the outer wall of the annular cylinder and, thus, leads to flowing of the hydraulic medium in the annular cylinder.

Although the thrust bearing and the circumferential annular cylinder may be filled with different hydraulic media, the thrust bearing and the annular cylinder are filled with a viscous mixture of lime dust. fine sand and bitumen.

BRIEF DESCRIPTION OF THE DRAWINGS

In the following, the invention is explained in more detail with the aid of an embodiment shown in the drawing.

DETAILED DESCRIPTION OF THE PREFERRED EMBODIMENT

Figure 1:
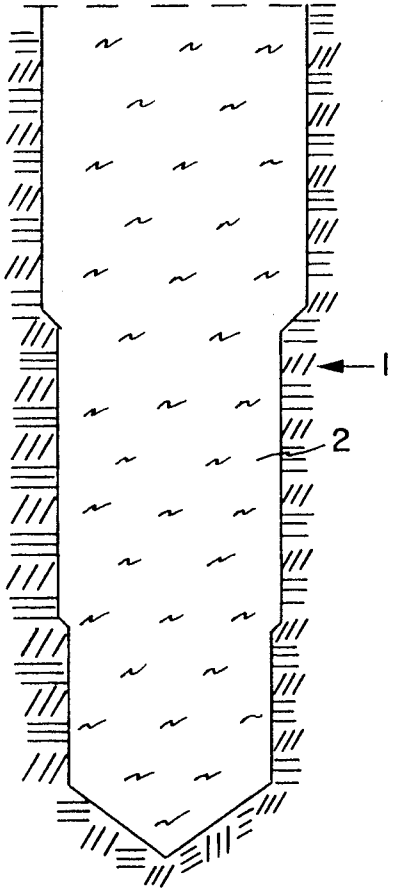

In FIG. 1, reference numeral 1 denotes the lower end of a bore shaft which is filled with drilling liquid 2.

Figure 2:
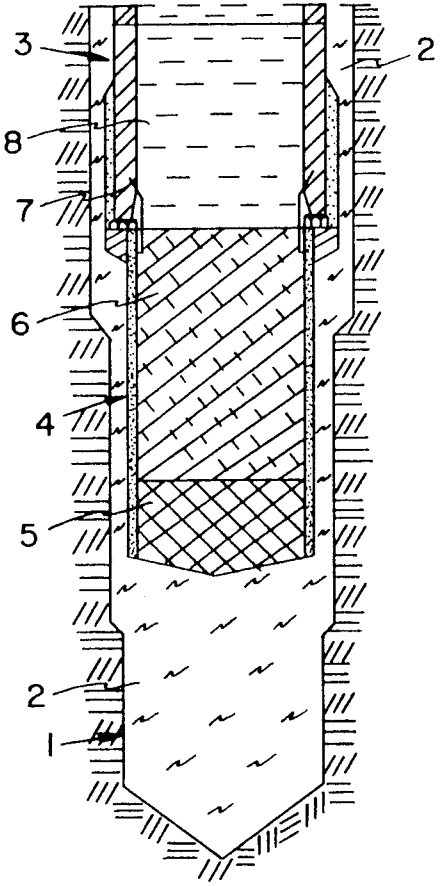

As shown in FIG. 2, an outwardly tight shaft structure 3 is floated into the bore shaft 1. For this purpose, a steel cylinder 4 is axially attached to the end face of the shaft structure 3 and is provided with a floating bottom 5 and a floating bottom supplement 6, particularly of concrete. Steel cylinder 4, floating bottom 5 and floating bottom supplement 6 form a ballast body which is connected to the shaft structure 3 through suspension member 7. Above the ballast body, the space within the shaft structure 3 is filled with ballast water 8.

Figure 3:
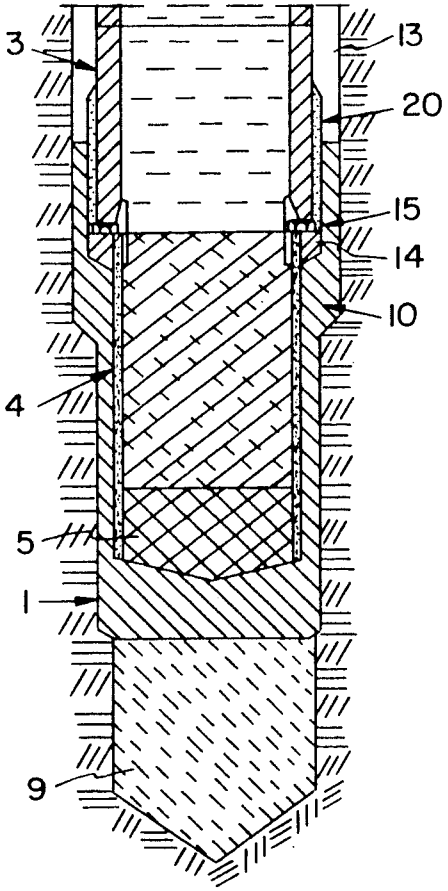
FIGS. 1 to 3 show, in vertical cross-section, different stages of the manufacture of a bore shaft foundation.
Figure 4:
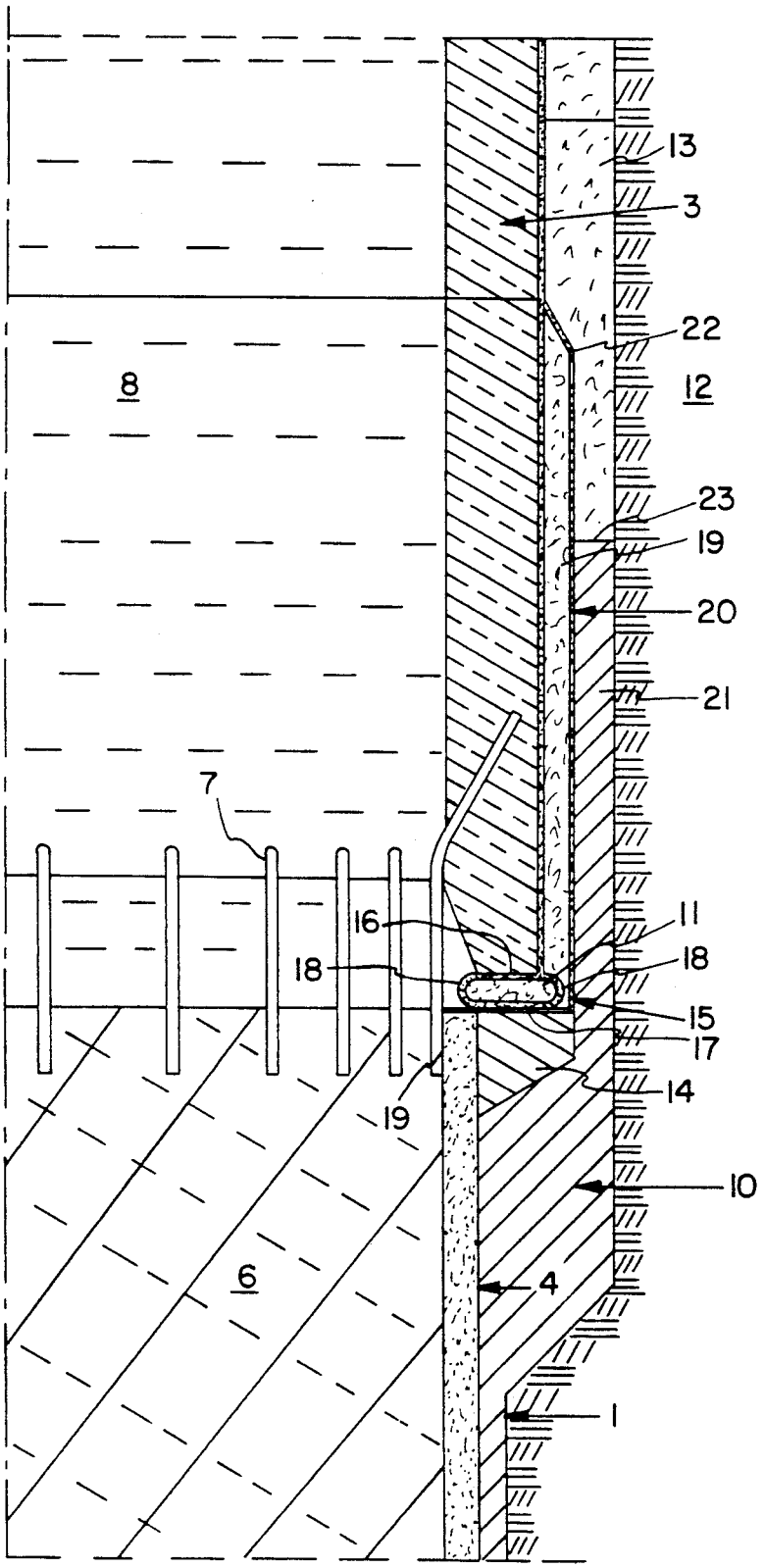
FIG. 4 shows in a vertical cross-section, on a larger scale, the water-tight portion of a bore shaft foundation.

When the shaft structure 3 has reached its intended end position shown in FIG. 2 (as also shown in FIGS. 3 and 4), the bottom of the bore shaft 1 is filled with sand 9 and the space between the sand 9 and the floating bottom 5, the space which circumferentially surrounds the steel cylinder 4 and the space which circumferentially surrounds the shaft structure 3 up to a height of 2 to 5 m above the end face 11 of the shaft structure 3 are filled with underwater concrete as the base 10, while displacing the drilling liquid 2.

The annular space between the shaft structure 3 and the ground 12 above the base 10 is filled with soft asphalt 13 while displacing the drilling liquid 2.

As can be seen particularly in FIG. 4, a reinforced concrete ring 14 whose height is about the same as its width is circumferentially mounted at the upper end of the steel cylinder 4. A thrust bearing 15 which is an annular steel cushion which is closed to all sides is arranged on the reinforced concrete ring 14. The thrust bearing 15 has an essentially oval cross-section with a flat upper side 16 and a flat lower side 17 which are connected to each other by arc-shaped portions 18 at the radially inner circumference and at the racially outer circumference. This thrust bearing 15 is filled with a non-corrosive liquid medium 19 of a viscous mixture of lime dust, fine sand and bitumen. The width of the thrust bearing 15 is adapted to the wall thickness of the shaft structure 3. The thrust bearing 15 has a height of between about 100 and 200 mm.

The shaft structure 3 rests vertically on the thrust bearing 15. Shaft structure 3 and thrust bearing 15 may be connected to each other.

A circular ring-shaped annular cylinder 20 with a steel jacket which is filled with a liquid medium is arranged on the circumference of the shaft structure 3. The annular cylinder 20 extends from the thrust bearing 15 along the portion 21 of the base 10 which circumferentially surrounds the shaft structure 3 for only a few meters up into the annular space with the soft asphalt 13. The upper edge 22 of the annular cylinder 20 ends approximately 1 meter above the end face 23 of the annular portion 21 of the base 10.

The annular cylinder 20 together with the outwardly tight shaft structure 3 is closed to all sides. It is also filled with a non-corrosive medium 19 of a viscous mixture of lime dust, fine sand and bitumen. The radial thickness of the annular cylinder 20 is about 100 to 200 mm.

The thrust bearing 15 and the annular cylinder 20 form a hydraulic tilting joint arrangement which makes it possible for the shaft structure 3 to tilt by approximately 1 to 2% relative to the base 10 without resulting in the danger that the loads caused by these tilting movements negatively influence the water-tightness of the bore shaft foundation. The shaft structure 3 rests with its lower end on a hydraulic cushion and is to the outside completely surrounded by liquid.

LIST OF REFERENCE NUMERALS

1—bore shaft
2—drilling liquid
3—shaft structure
4—steel cylinder
5—floating bottom
6—floating bottom supplement
7—suspension members
8—ballast water
9—sand
10—base
11—end face of 3
12—ground
13—asphalt
14—reinforced concrete ring
15—thrust bearing
16—upper side of 15
17—lower side of 15
18—arc-shaped portion
19—medium in 15 and 20
20—annular cylinder
21—portion of 10
22—upper edge of 20
23—end face of 21

I claim:

1. Water-tight bore shaft foundation, particularly for bore shafts which are subjected to significant mining influences, the bore shaft foundations being formed by a base (10) for a shaft structure (3), the base (10) being made of underwater concrete after the outwardly tight shaft structure has been floated in, and by a soft asphalt (13) introduced into the annular space between the shaft structure (3) and the ground above the base (10) while displacing the drilling liquid (2), characterized in that a hydraulic tilting joint arrangement (15, 20) is provided between the base (10) and the shaft structure (3), the tilting joint arrangement being formed by a thrust bearing arranged on the end face of the shaft structure (3) and filled with a hydraulic medium (19) and by an annular cylinder (20) which rests circumferentially on the outside of the lower portion of the shaft structure (3), the annular cylinder being formed of a steel jacket which is also filled with the hydraulic medium (19), and that the annular cylinder (20) extends from the thrust bearing (15) upwardly through an end face (23) of a portion (21) of the base (10) which surrounds in a circular ring shape the shaft structure (3) up into the annular space with the soft asphalt (13).

2. Bore shaft foundation according to claim 1, characterized in that the thrust bearing (15) is formed by an annular steel cushion which is closed to all sides and which is filled with a non-corrosive hydraulic medium (19).

3. Bore shaft foundation according to claims 1 or 2, characterized in that the thrust bearing (15) is connected to the shaft structure (3).

4. Bore shaft foundation according to claim 1, characterized in that the annular cylinder (20) is formed by a steel cylinder having a circular ring-shaped horizontal cross-section, the steel cylinder being closed to all sides and filled with a non-corrosive hydraulic medium (19), and being connected to the shaft structure (3).

5. Bore shaft foundation according to one of claims 1, 2, or 4 characterized in that the thrust bearing (15) and the annular cylinder (20) are filled with a viscous mixture of lime dust, fine sand and bitumen.

* * * * *